US005758769A

United States Patent [19]

Vasudeva

[11] Patent Number: 5,758,769

[45] Date of Patent: Jun. 2, 1998

[54] TOOL CASE

[75] Inventor: Kailash C. Vasudeva, Waterloo, Canada

[73] Assignee: Mastercut Industries Inc., Waterloo, Canada

[21] Appl. No.: 586,286

[22] Filed: Jan. 16, 1996

[51] Int. Cl.[6] ..... B65D 85/28

[52] U.S. Cl. ..... 206/372; 206/378; 220/326; 220/507

[58] Field of Search ..... 206/349, 375, 206/373, 372, 378; 220/326, 507, 504, 527, 306, 334, 242

[56] References Cited

U.S. PATENT DOCUMENTS

| | | | |
|---|---|---|---|
| 2,314,717 | 3/1943 | Landwehr | 220/326 |
| 2,760,674 | 8/1956 | Karp | 220/326 |
| 4,340,139 | 7/1982 | Wilcox et al. | 206/349 |
| 4,799,604 | 1/1989 | Okojima et al. | 220/326 |
| 4,836,374 | 6/1989 | Hutchins et al. | 206/373 |
| 4,901,664 | 2/1990 | Labrecque | 206/573 |
| 5,114,007 | 5/1992 | Chen | 206/373 |

*Primary Examiner*—Jimmy G. Foster
*Assistant Examiner*—Nhan T. Lam
*Attorney, Agent, or Firm*—R. Craig Armstrong

[57] ABSTRACT

A tool case is provided with more storage than conventional tool cases, and has a lidded storage area which does not reduce the area available for primary storage. The box portion of the tool case has a recess in the bottom thereof, defining a secondary storage area on the opposite side of the case from the lid. The secondary storage area also has a lid, so that pieces can be stored without falling out.

9 Claims, 4 Drawing Sheets

TOOL CASE

BACKGROUND OF THE INVENTION

This invention relates to a tool case, particularly of the type used to display a tool set at the point of sale, and to subsequently store the tool set. Such tool cases are commonly referred to as "gift cases".

Cases of the general type are well known, and typically include an open-topped box portion and a lid hinged to the box portion, with a clip to hold the lid shut. A plastic insert in the box typically has recesses defined therein to accommodate various tools and components, such as a screwdriver and various bits therefore The lid frequently has a transparent face, so that the tools can be seen when the case is closed.

Such cases frequently have small bins provided by virtue of recesses in the plastic insert, for storage of miscellaneous items (screws, for example) or for secondary storage of the items in the tool set, i.e. instead of in the recesses designed as their primary storage areas. However, since inexpensive, thin plastic is typically used for the inserts, these bins have no structural rigidity, and no lid, so any bits or other items are not contained, and can easily fall out. Also, any such bins reduce the area available for storage of bits or other items in their primary recesses.

SUMMARY OF THE INVENTION

It is an object of the invention to provide an improved gift case, embodying more storage than in conventional tool cases, and providing a lidded storage area which does not reduce the area available for primary storage.

In the invention, the box portion of the tool case has a recess in the bottom thereof, defining a secondary storage area on the opposite side of the case from the lid. The secondary storage area also has a lid, so that pieces can be stored without falling out.

BRIEF DESCRIPTION OF THE DRAWINGS

The invention will now be described in detail with reference to the accompanying drawings, in which.

DETAILED DESCRIPTION OF THE PREFERRED EMBODIMENTS

Figure 1:
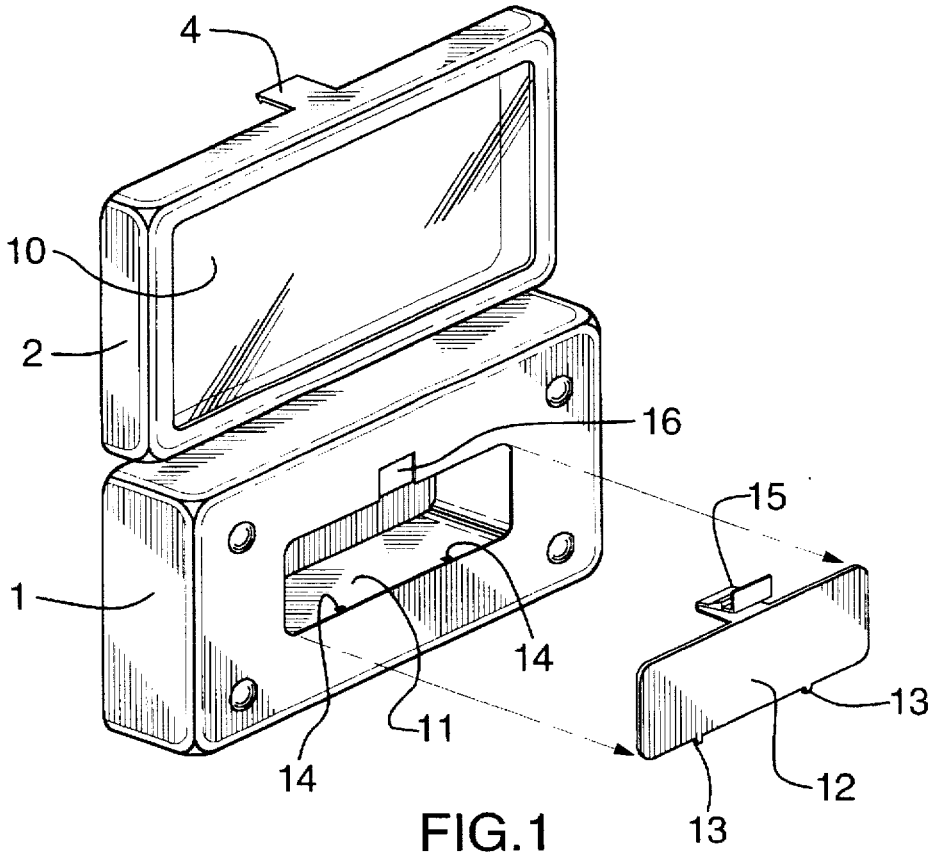
FIG. 1 is a perspective view of a typical embodiment of the case, showing the compartment in the undeiside thereof.
Figure 2:
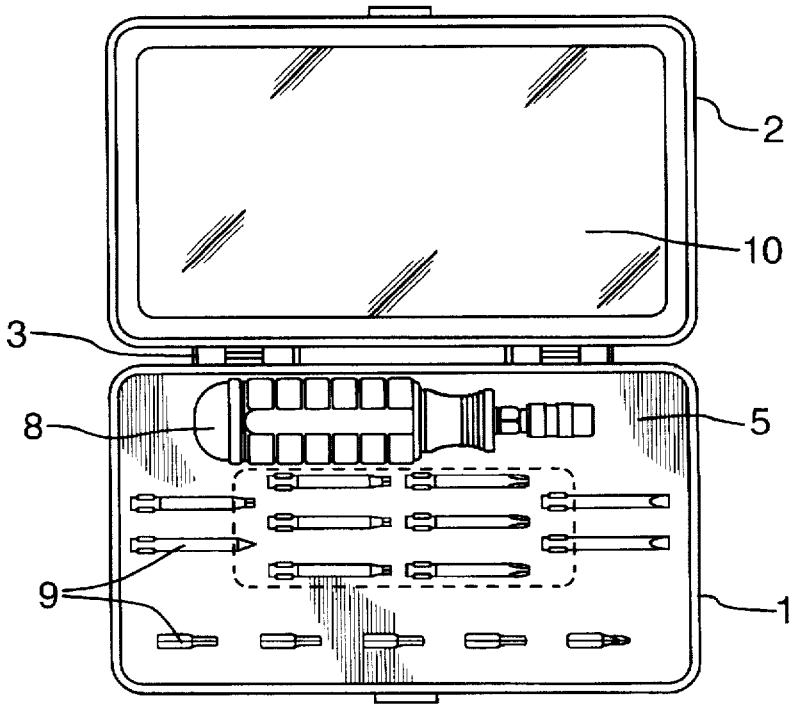
FIG. 2 a plan view of the embodiment of FIG. 1.

Referring to the drawings, FIG. 1 shows the case, which includes a main box portion 1 and a lid 2 hinged to the box portion, for example by two hinges 3, typically integral "living" plastic hinges. A clip 4 holds the lid shut in conventional fashion. The main box portion typically is blow molded, and thus has a hollow area between the outer shell and the plastic upper surface 5. The upper surface of the box portion has various recesses 6 defined therein to accommodate tools and components, such as a screwdriver or other large tool 8 and various bits or other small tools 9 to go with the large tool. The recesses may include clips 7 to hold the items, or the items may be held simply by virtue of a tight fit within the recesses, the recesses being somewhat resilient. The lid typically has a transparent face 10, so that the tools can be seen when the case is closed.

Figure 3:
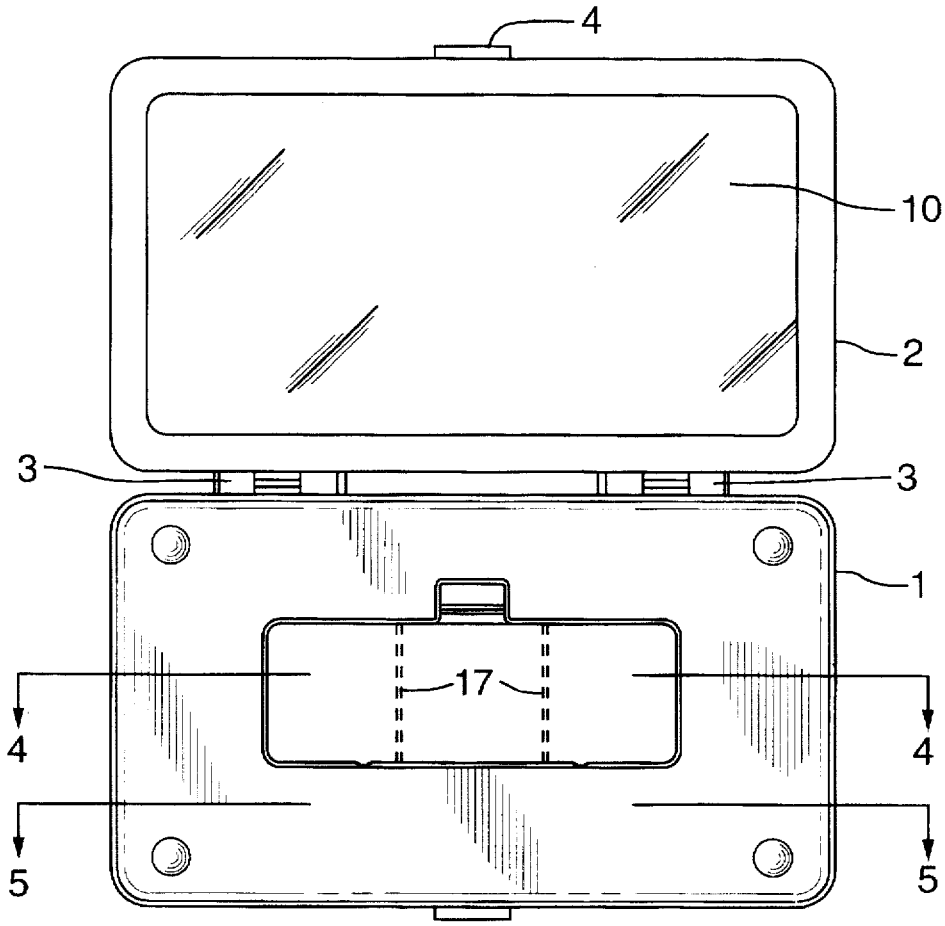
FIG. 3 is a bottom view of the embodiment of FIG. 1.
Figure 4:
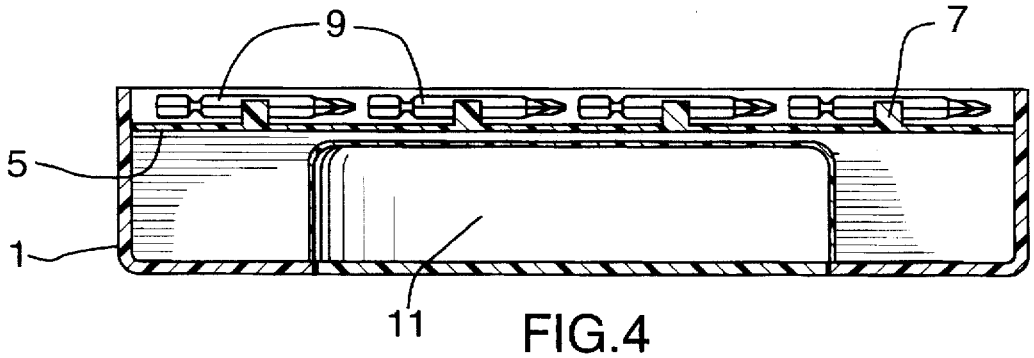
FIG. 4 is a side cross-section at 4—4 of FIG. 3.
Figure 5:
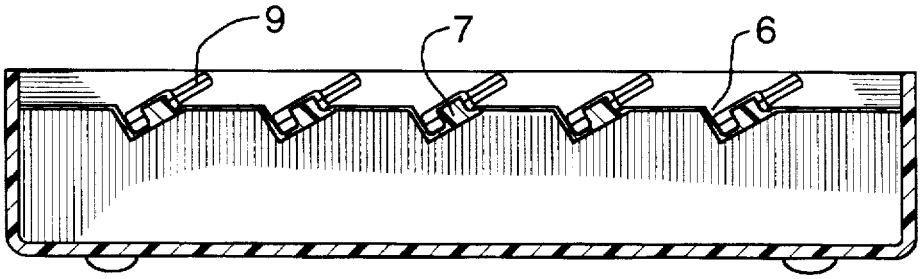
FIG. 5 is a side cross-section at 5—5 of FIG. 3.
Figure 7:
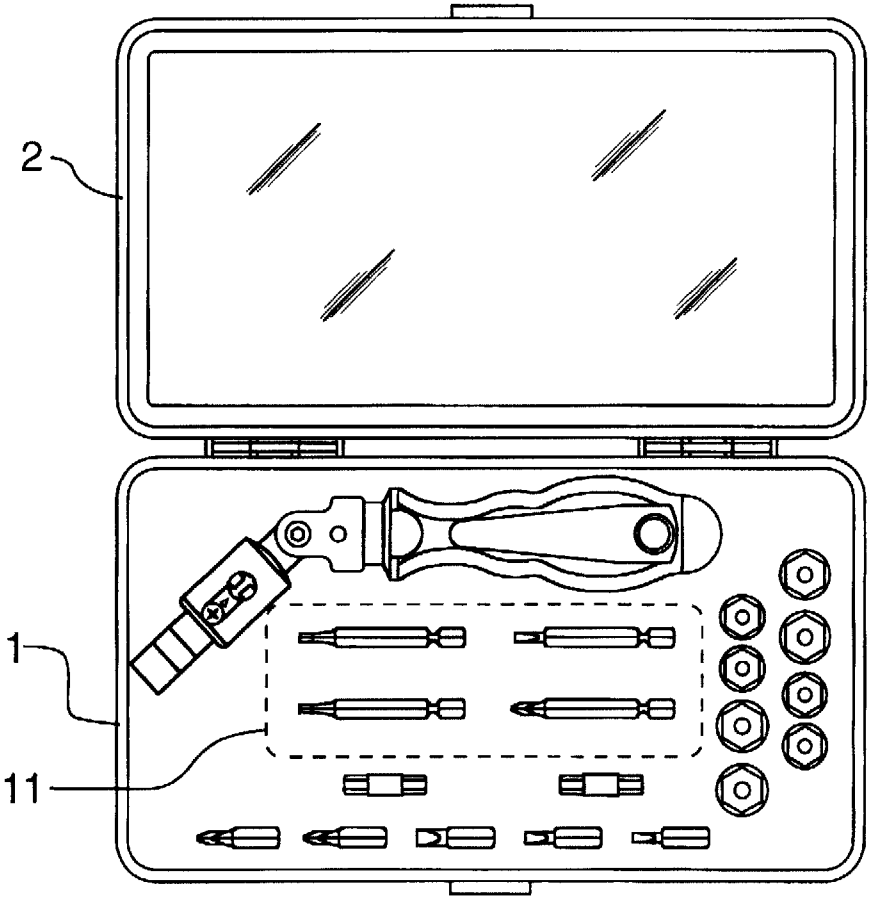
FIGS. 6 to 9 are plan view of other typical embodiments, configured for various other tool sets.
Figure 6:
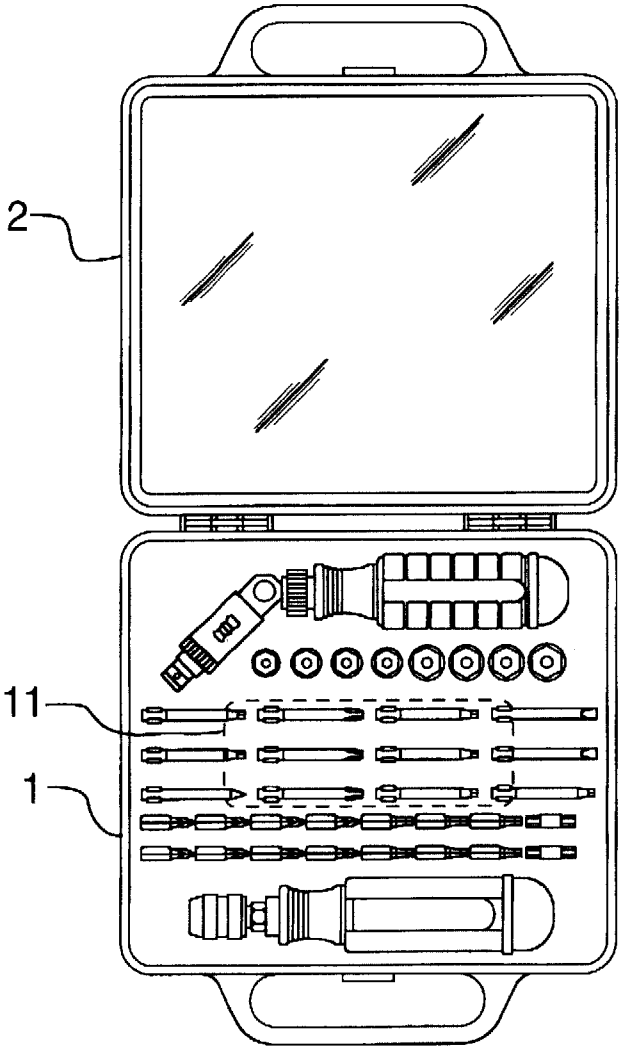
Figure 9:
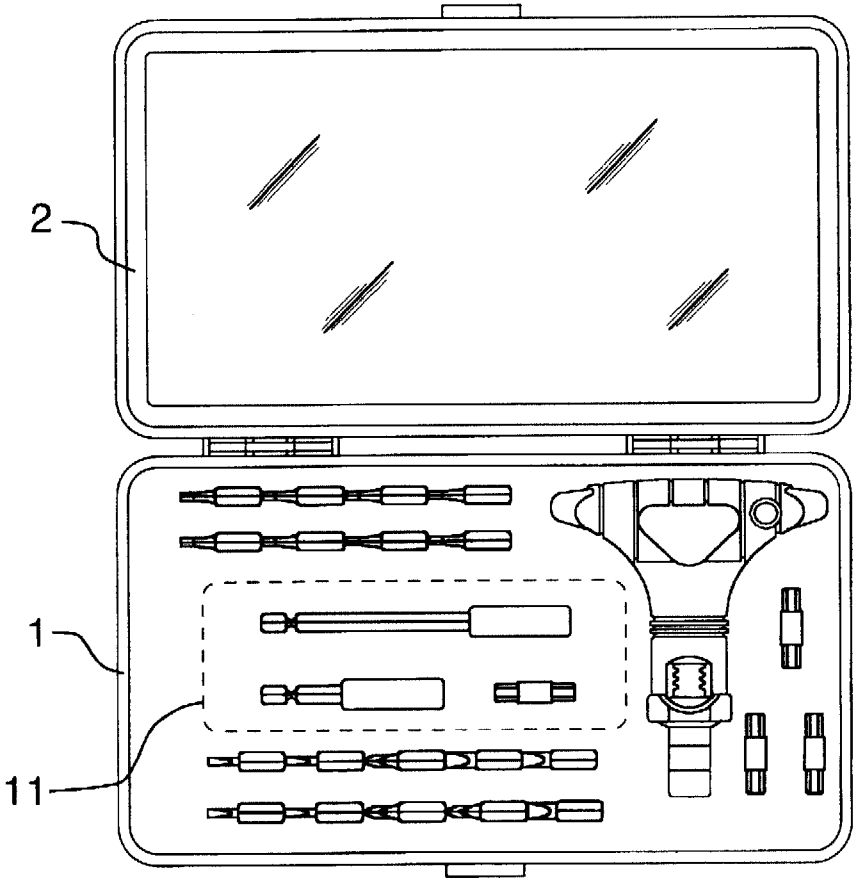
Figure 8:
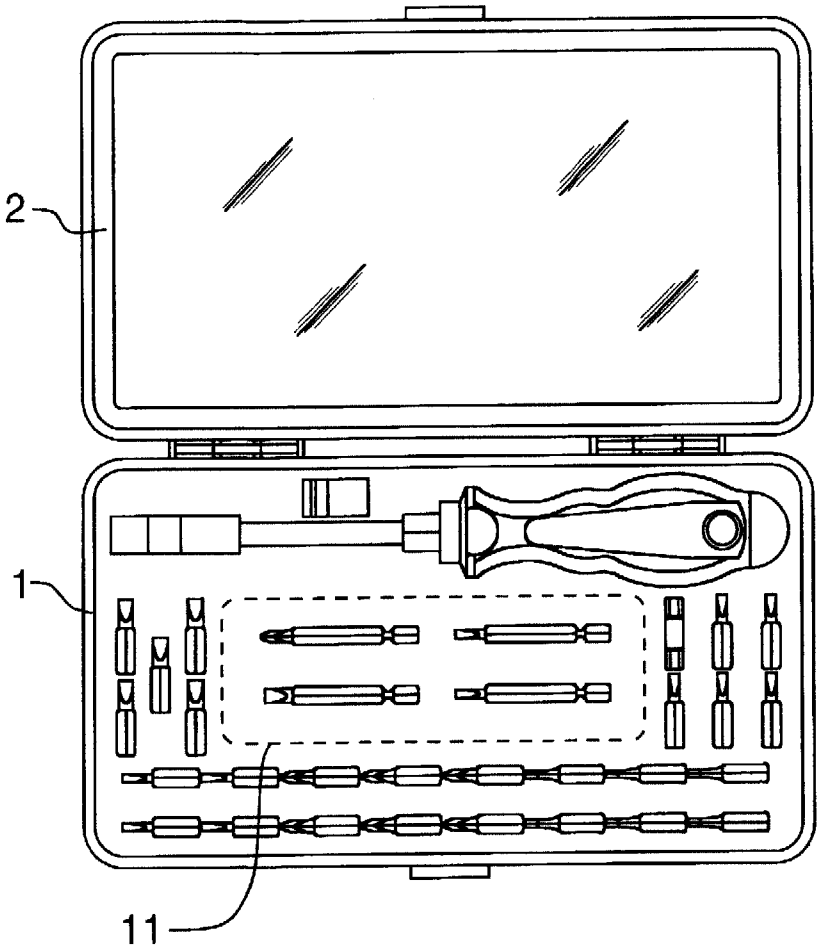

As seen most clearly in FIGS. 1, 3 and 4, the box portion of the tool case has a large recess in the bottom thereof, defining a secondary storage area 11 on the opposite side of the case from the lid. The secondary storage area also has a lid 12, so that pieces can be stored without falling out. The lid may be permanently attached, or as shown, may be held in place by tabs 13 which fit into small holes or slots 14, with a resilient clip 15 integral with the lid serving to hold the lid shut, the outermost portion of the clip fitting into a small recess 16. The clip snaps into place in conventional fashion by virtue of a small lip, such that it must be moved towards the main portion of the lid in order to be released to allow the lid to be opened. Optional dividers 17 may be provided within the storage area, if desired.

Preferably, in order to maximize the depth of the secondary storage area, it is positioned beneath those components 9 which are positioned entirely above the upper surface 5. However, the area could also be positioned in whole or in part beneath recesses 6 for components 9, albeit with some loss of depth. The area would not normally extend beneath the main tool 8, since the case would not normally provide enough depth there. (If there is depth there, then the case really is oversized for the tool set.)

It will be appreciated that many variations on the invention are possible, in keeping with the principle of the invention. FIGS. 6 to 9 for example show various other possible configurations. Many others are obviously possible, and are contemplated as being within the scope of the invention as defined by the accompanying claims.

What is claimed as the invention is:

1. A tool case, comprising:

a main box portion defined by a generally planar lower surface, four sidewalls extending upwardly therefrom, and an upper surface extending across said main box portion, said upper surface of said main box portion having at least one large recess extending a substantial depth below said upper surface towards said lower surface to receive a tool, a plurality of smaller recesses extending only a short depth below said upper surface to receive components for use with said tool, and at least one area having no recesses; and a lid hinged to said main box portion, said lid having a top and four sidewalls extending downwardly therefrom, at least a substantial portion of said top being transparent; said lower surface having a cavity defined therein constituting a secondary storage area extending upwardly towards said upper surface, said cavity being positioned only beneath one of said unrecessed areas, and not beneath either said at least one large recess or said smaller recesses, said tool case further comprising a cover positionable across said cavity to cover said cavity.

2. A tool case as recited in claim 1, where said unrecessed areas have tool component receiving elements extending upwardly therefrom, to hold tool components without using a recess.

3. A tool case as recited in claim 1, where said smaller recesses are angled away from the horizontal to carry said components at an angle to the horizontal such that said components have an upper end projecting above said upper surface.

4. A tool case as recited in claim 1, said cover having tabs along one edge which fit into holes in said main box portion adjacent said lower surface, said cover further having a resilient clip centered along an edge opposite the edge with said tabs, said resilient clip being configured to engage said main box portion to retain said cover in place.

5. A tool case as recited in claim 1, where said unrecessed areas have tool component receiving elements extending upwardly therefrom, to hold tool components without using a recess, where said smaller recesses are angled away from the horizontal to carry said components at an angle to the horizontal such that said components have an upper end projecting above said upper surface, and where said cover has tabs along one edge which fit into holes in said main box portion adjacent said lower surface, said cover further having a resilient clip centered along an edge opposite the edge with said tabs, said resilient clip being configured to engage said main box portion to retain said cover in place.

6. A tool case, comprising:

a main box portion defined by a generally planar lower surface, four sidewalls extending upwardly therefrom, and an upper surface extending across said main box portion, said upper surface of said main box portion having at least one large recess extending a substantial depth below said upper surface towards said lower surface to receive a tool, a plurality of smaller recesses extending only a short depth below said upper surface to receive components for use with said tool, and at least one area having no recesses; and a lid hinged to said main box portion, said lid having a top and four sidewalls extending downwardly therefrom, at least a substantial portion of said top being transparent; said lower surface having a cavity defined therein constituting a secondary storage area extending upwardly towards said upper surface, said cavity being positioned beneath at least some of said smaller recesses, and not beneath said at least one large recess, said tool case further comprising a cover positionable across said cavity to cover said cavity, said cover having tabs along one edge which fit into holes in said main box portion adjacent said lower surface, said cover further having a resilient clip centered along an edge opposite the edge with said tabs, said resilient clip being configured to engage said main box portion to retain said cover in place.

7. A tool case as recited in claim 6, where said unrecessed areas have tool component receiving elements extending upwardly therefrom, to hold tool components without using a recess.

8. A tool case as recited in claim 6, where said smaller recesses are angled away from the horizontal to carry said components at an angle to the horizontal such that said components have an upper end projecting above said upper surface.

9. A tool case as recited in claim 6, where said unrecessed areas have tool component receiving elements extending upwardly therefrom, to hold tool components without using a recess, and where said smaller recesses are angled away from the horizontal to carry said components at an angle to the horizontal such that said components have an upper end projecting above said upper surface.

* * * * *